US005533625A

United States Patent [19]

Mikkelsen

[11] Patent Number: 5,533,625

[45] Date of Patent: Jul. 9, 1996

[54] CONTAINER WITH INTERNAL LIFT MECHANISM

[76] Inventor: Dennis L. Mikkelsen, 17538 Second Pl. NE., Seattle, Wash. 98155

[21] Appl. No.: 292,069

[22] Filed: Aug. 17, 1994

[51] Int. Cl.[6] ..... B65D 79/00

[52] U.S. Cl. ..... 206/565; 206/315.1; 206/738; 206/755

[58] Field of Search ..... 206/45.13, 45.15, 206/45.18, 315.1, 315.11, 565, 579

[56] References Cited

U.S. PATENT DOCUMENTS

| | | | |
|---|---|---|---|
| 1,666,001 | 4/1928 | Catala . | |
| 1,859,401 | 5/1932 | Lengsfield . | |
| 2,430,707 | 11/1947 | Cahn . | |
| 2,589,593 | 3/1952 | Anderson et al. . | |
| 2,657,793 | 11/1953 | Goldshine | 206/45.13 |
| 2,698,083 | 12/1954 | Palson | 206/45.13 |
| 2,775,342 | 12/1956 | Smith | 206/45.13 |
| 2,792,935 | 5/1957 | Rocchetti . | |
| 3,074,539 | 1/1963 | Rogovin . | |
| 3,086,645 | 4/1963 | Yount | 206/45.13 |
| 3,350,810 | 11/1967 | Warner et al. | 206/315.11 |
| 3,353,657 | 11/1967 | Young . | |
| 3,367,483 | 2/1968 | Studen . | |
| 3,642,123 | 2/1972 | Knox . | |
| 3,900,100 | 8/1975 | Girman . | |
| 4,006,821 | 2/1977 | Sautter . | |
| 4,162,005 | 7/1979 | Linger . | |
| 4,467,947 | 8/1984 | Minneman . | |
| 4,493,417 | 1/1985 | Ackeret | 206/387 |
| 4,573,569 | 3/1986 | Parker . | |
| 4,598,822 | 7/1986 | Hemmings . | |
| 4,615,445 | 10/1986 | Stocchiero | 206/444 |
| 4,634,001 | 1/1987 | Wakelin . | |
| 4,655,342 | 4/1987 | Brauner et al. | 206/45.18 |
| 4,657,138 | 4/1987 | Watson . | |
| 4,756,405 | 7/1988 | Crozier . | |
| 5,096,055 | 3/1992 | Opper . | |
| 5,123,532 | 6/1992 | Rau et al. | 206/379 |
| 5,165,537 | 11/1992 | Neff et al. | 206/315.1 |
| 5,193,672 | 3/1993 | Long . | |
| 5,238,108 | 8/1993 | Velezis et al. | 206/315.1 |

*Primary Examiner*—Steven N. Meyers
*Assistant Examiner*—Tara L. Laster
*Attorney, Agent, or Firm*—Christensen, O'Connor, Johnson & Kindness

[57] ABSTRACT

A container for storing objects is disclosed. The container includes a housing, a lid, a tray, and a lift mechanism. The lid is pivotally attached to the housing. The tray is pivotally attached within the housing and is adapted to removably secure objects thereon. The tray pivots about an axis generally transverse to the pivot axis of the lid. A lift mechanism is coupled between the tray and the lid for lifting at least a portion of the tray upon opening of the lid. In one embodiment, the lift mechanism includes a lift arm and a lift member. The lift arm is secured to the lid. The lift member is pivotally coupled to the lift arm and coupled to the tray. In another embodiment, a spring and retraction arm are used as the lift mechanism. A line coupled between the lid and tray is also disclosed.

13 Claims, 11 Drawing Sheets

CONTAINER WITH INTERNAL LIFT MECHANISM

FIELD OF THE INVENTION

The present invention relates to containers for storing objects and, more particularly, to containers with mechanisms for lifting the container's contents for ease of placing objects in and removing them from the container.

BACKGROUND OF THE INVENTION

Storage of objects in containers is a necessity. However, once the objects are in the container they may not always be quickly and easily removed, depending on the type of object and the type of container. Containers for both storing objects and making them easily accessible once the container is opened have been developed. Drill bit cases, for example, have been manufactured that store a series of bits in an organized fashion and lift the bits upwardly, upon opening of the case, for ease of access to the bits. U.S. Pat. Nos. 4,006,821 and 3,074,539 disclose such cases. The trays that hold the bits are linked to the lid such that when it is opened the trays are pivoted upwardly. These trays each pivot along an axis parallel to the pivotal axis of the lid. Thus, for elongate objects the lid must be attached along a short side of the case and swung open to lift the trays to remove the contents.

Other containers that lift their contents upon opening have also been developed that do not employ linkages to lift the trays. See U.S. Pat. Nos. 1,666,001; 1,859,401; 2,430,707; and 3,353,657. Each of these containers also pivotally lifts its inner tray along an axis parallel to the pivotal axis about which the lid itself opens but on the opposite side of the container. Thus, the lifted portion of the tray is adjacent the lid itself. Therefore, the contents are not much easier to remove and the containers are primarily intended only for display of the contents when opened. Elongate objects, such as darts or instruments, are not made easier to grasp for placing and removing such objects from the containers.

Problems may also arise in some of these containers with the lid contacting, and thus interfering with, the tray or its contents. For example, the box disclosed in U.S. Pat. No. 1,859,401 relies on the inner surface of the lid to force the tray down into the housing. The problem of tray and object interference would be worsened with any of the above mechanisms if the tray were lifted along an axis transverse to the lid hinges, especially with elongate objects. In such a case, the ends of the elongate objects must be lifted and retracted in such a way that they avoid interfering with the opening and closing of the lid.

Also, none of the containers discloses any extra storage space for small articles related to the objects stored on the trays. For example, if darts are stored, extra tips may need to be securely stored as well.

Because of the above-described drawbacks inherent in the current cases with lift trays, the present invention was developed. The container of the present invention safely stores objects, such as darts or instruments, without damage to or interference with the objects upon opening or closing of the container and allows the objects to be pivoted upwardly about an axis transverse to the axis of the lid hinges when the lid is opened for ease of removing and resecuring the objects.

SUMMARY OF THE INVENTION

A container for storing objects is provided. The container preferably includes a housing, a lid, a tray, and a lift mechanism. The lid is pivotally attached to the housing. The tray is pivotally attached within the housing and is adapted to removably secure objects thereon. A lift mechanism is coupled between the tray and the lid for lifting at least a portion of the tray upon opening of the lid. The lift mechanism includes a lift arm and a lift member. The lift arm is secured to the lid. The lift member is pivotally coupled to the lift arm and coupled to the tray.

In the preferred form of the invention the container includes a drawer slidably coupled within the housing beneath the tray. The tray has a lock projection that extends below the bottom surface of the tray and projects within at least a portion of the drawer when the lid is in a closed position. In its preferred form, the lock projection is a wedge and the drawer includes a complementary recess for receiving the wedge.

In the preferred embodiment, the housing includes a support member beneath the tray for holding the tray in a predetermined orientation within the housing when the lid is closed on the housing. This support member is preferably in the form of a wall disposed between the drawer and the tray.

Also in the preferred embodiment, the lid and the tray pivot about different axes. The pivot axis of the tray is generally transverse to the pivot axis of the lid. The lift member is slidably coupled to the tray. The lift arm preferably projects downwardly from the lid past the pivotal connection of the lid to the housing. In the preferred embodiment, the lift member is made of a rod and the tray includes a tapered recess for receiving the rod. The recess has its wide portion near the lift arm to provide for delayed lifting of the tray upon opening of the lid. This provides for lengthy objects to be stored on the tray without their interfering with the opening and closing of the lid.

In an alternate embodiment of the invention, the lift member includes an end with a hook. In this embodiment the tray includes a recess for receiving the lift member and the hook. A portion of the recess near the end of the lift member is wider, such that it can receive the hook and allow contact of the hook to stop pivotal movement of the lid.

Alternatively, the lid may include a stop member for limiting pivotal movement of the lid.

Another alternate embodiment of the invention is provided that includes a case for storing and accessing objects. The case includes a housing, a lid, a tray, and a lift mechanism. The lid is pivotally attached to the housing. The tray is pivotally attached within the housing and has a means for removably securing objects thereon. The lift mechanism is coupled between the tray and the lid for lifting at least a portion of the tray upon opening of the lid. The lift mechanism in this embodiment includes a line and a slide mount. The line has a first end secured to the lid and a second end secured to the tray at an end of the tray opposite that portion of the tray that is lifted. The slide mount is secured to the housing. The mount slidably engages the line between the first and second ends of the line, so that, upon opening of the lid, the line pulls an end of the tray further within the housing to pivot the tray about its attachment to the housing.

In this embodiment, the lid and the tray preferably pivot about different axes, the pivot axis of the tray being generally transverse to the pivot axis of the lid. The housing includes a support member beneath the tray for holding the tray in a predetermined orientation within the housing when the lid is closed.

In still another alternate embodiment of the invention, a container for storing objects is provided that includes a housing, a lid, a tray, biasing means, and a retraction arm.

The biasing means are secured between the housing and the tray. The biasing means bias the tray in a direction away from the interior of the housing. The retraction arm is secured to the lid and positioned to contact the tray as the lid is closed. This retraction arm moves the tray within the housing as the lid is closed such that objects do not interfere with the closing of the lid. The retraction arm allows the tray to lift in response to the biasing means when the lid is opened. Preferably, the biasing means comprise a conical helical spring.

This embodiment may also include a drawer slidably coupled within the housing beneath the tray.

In one embodiment of this alternate construction including the retraction arm, the retraction arm includes a curved cam surface for contacting a portion of the top of the tray. Preferably, the cam contacts and moves the tray through ninety degrees of pivotal motion of the lid.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 1 is an isometric view of the container of the present invention illustrating its use in storing and lifting darts;

DETAILED DESCRIPTION OF THE PREFERRED EMBODIMENTS

The basic elements of a container or case 20 will first be described with reference to FIGS. 1–3. These figures illustrate the preferred embodiment of the invention. FIGS. 4–7 will then be referred to as pan of the discussion of the operation of the preferred embodiment. Various alternative elements and embodiments of the invention, all falling within the general scope of the invention, will then be discussed with reference to FIGS. 8–19.

Figure 2:
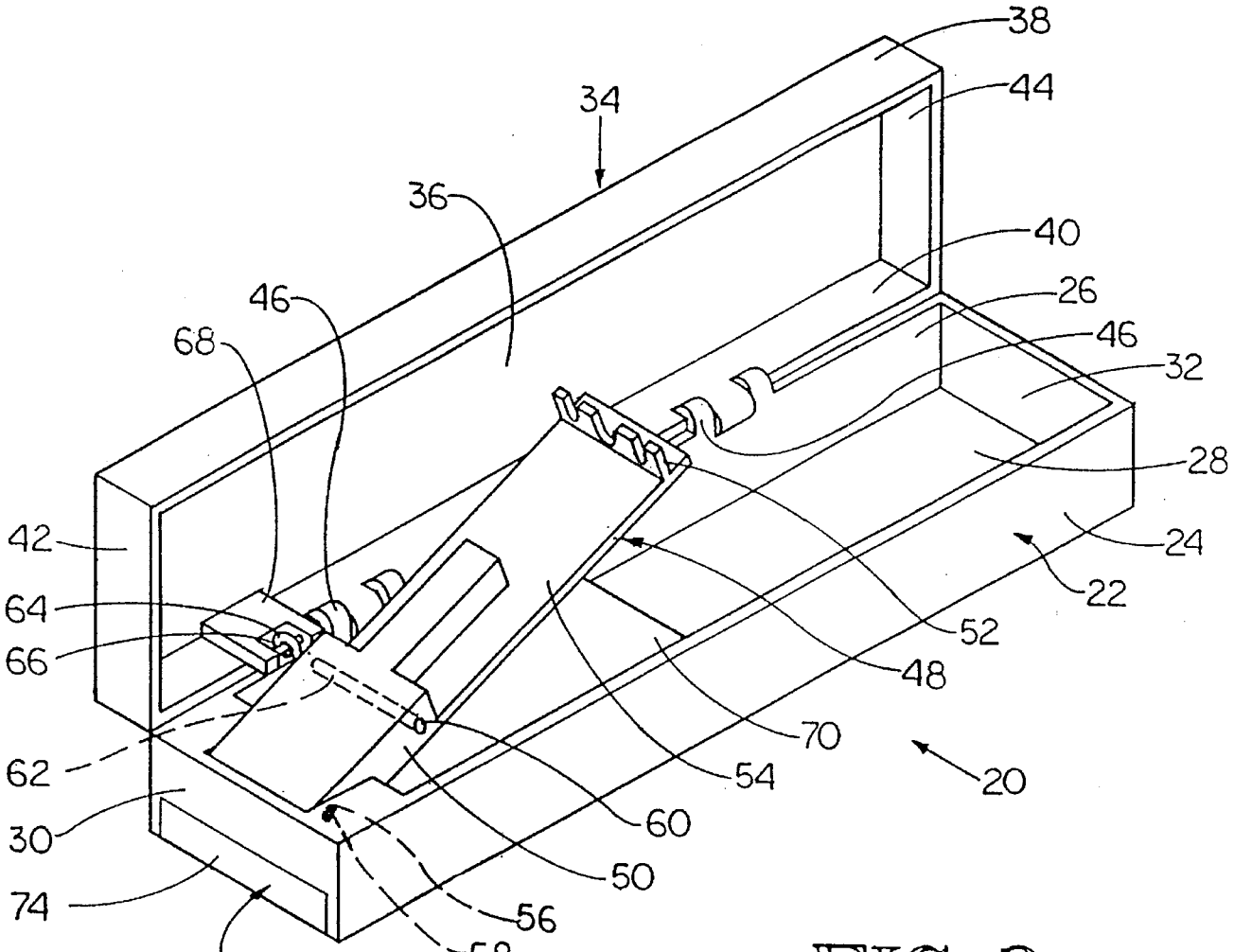
FIG. 2 is an isometric view of the container of the present invention shown without anything being held by the container.
Figure 3:
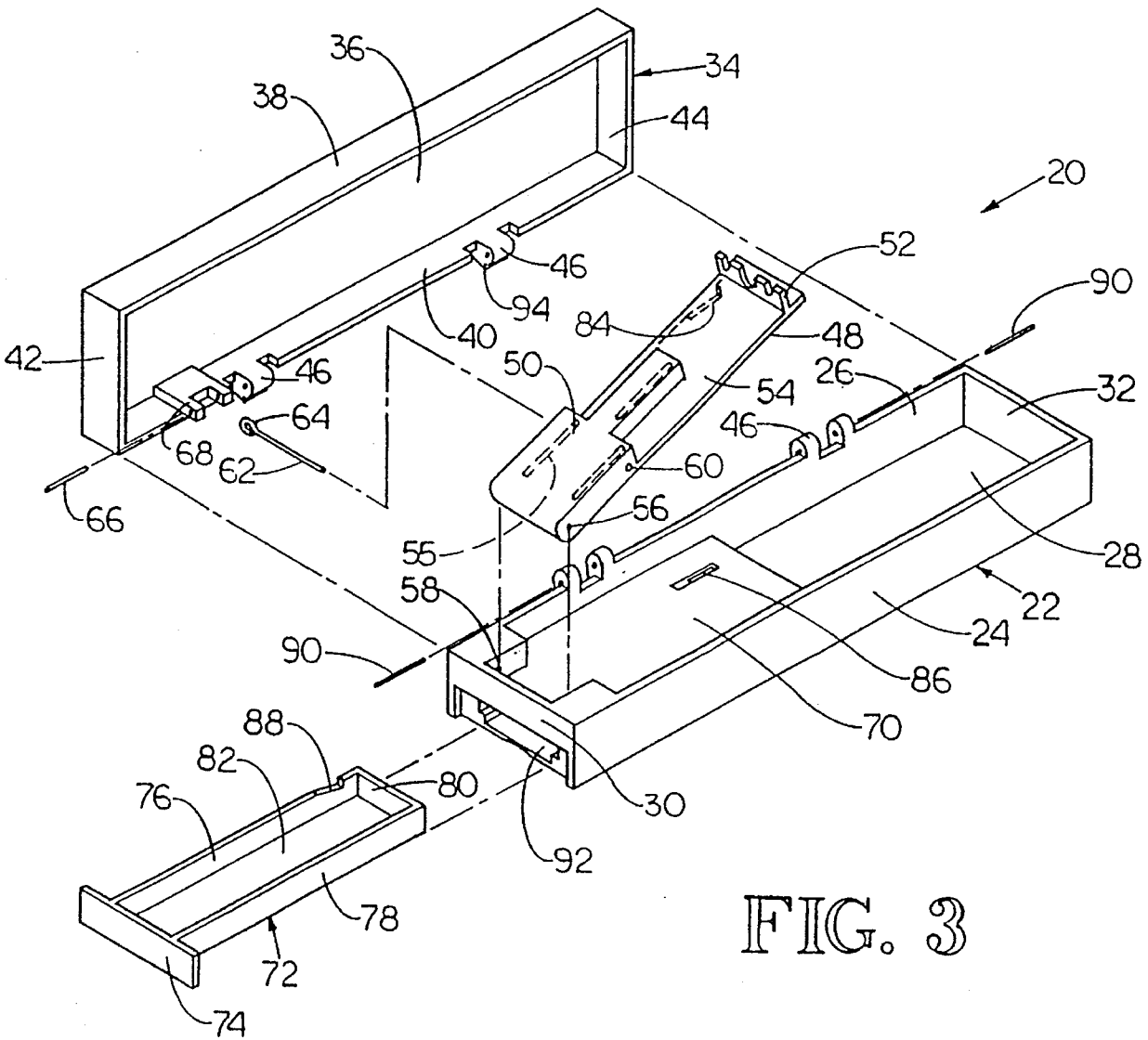
FIG. 3 is an exploded isometric view of the container of the present invention.

Referring first to FIGS. 1–3, case 20 includes a housing 22, a lid 34, a lift tray 48, and a drawer 72. Housing 22 has a generally parallelepiped shape like that of an open box. Housing 22 includes a front 24, a back 26, a bottom 28, a left end 30, and a right end 32. The major axis of housing 22 is parallel to front 24 and back 26. The depth of housing 22 is preferably slightly less than the width, the length being several times the width. Alternatively, other relative dimensions could be used.

Lid 34 includes a top 36, a front 38, a back 40, a left end 42, and a right end 44. Lid 34 is similar to housing 22 in that it is generally parallelepiped in shape and has approximately the same length and width, the depth being preferably slightly less than the depth of housing 22. Together, housing 22 and lid 34 form the basic shell of case 20.

Lid hinges 46 are provided between back 26 of housing 22 and back 40 of lid 34. Lid hinges 46 can be of any type available, but are preferably piano-type hinges that allow simple pivotal movement of lid 34 relative to housing 22, about an axis between back sides 26 and 40 of housing 22 and lid 34. Lid hinge pins 90 couple the two portions of lid hinges 46 together for pivotal movement along the axes of lid hinge pins 90. Preferably, a lid stop 94 is also provided on hinges 46 such that lid 34 may be opened only 90 degrees from its closed position. Lid stops 94 are simply rearward projections extending from the backs of lid hinges 46 such that they contact back 26 of housing 22 when lid 34 is opened 90 degrees. The stopping action of lid stop 94 may be readily seen in FIG. 7.

Lift tray 48 has a longitudinal axis within a vertical plane containing the longitudinal axis of housing 22. Lift tray 48 has a generally rectangular shape with a thicker end block 50 at the left end and a notched end wall 52 near the right end. A plate portion 54 extends from end block 50 just past notched end wall 52. The bottom surface of end block 50 is coplanar with the bottom surface of plate portion 54. However, end block 50 has a greater thickness than plate portion 54 such that it projects upwardly therefrom. End block 50 may also have an extended portion that continues preferably in the middle of plate portion 54 toward notched end wall 52 for offsetting of objects held on lift tray 48. Instrument recesses 55 are bored within the right side of end block 50 to hold instruments, such as darts D illustrated in FIG. 2. Notched end wall 52 projects perpendicularly upward from near the right end of plate portion 54. Notched end wall 52 includes notches arranged to hold and space objects, such as darts D, when held on lilt tray 48.

Lift tray 48 is pivotally attached to housing 22 at the left end of end block 50. Preferably, pivot recesses 56 are provided in the sides of end block 50. Pivot recesses 56 lie along a common axis perpendicular to the longitudinal axis of lift tray 48. Pivot recesses 56 are matably engaged with pivot dimples 58 provided within housing 22. The back left inside comer of housing 22 as well as the front left inside comer of housing 22 project inwardly and include dimples 58 projecting further inwardly to matably engage within pivot recesses 56. Pivot dimples 58 also lie along an axis perpendicular to the longitudinal axis of housing 22. Thus, lift tray 48, by this pivotal connection between pivot recesses 56 and pivot dimples 58, is pivotally secured to housing 22 such that its major axis lies within a vertical plane containing the major axis of housing 22. In other words, the right end of lift tray 48 can pivot upwardly from within housing 22.

Alternative means of creating the pivotal attachment between lift tray 48 and housing 22 are possible. For example, a bore through the end of block 50 combined with a rod or rods extending through the bore and into the sides of housing 22 would perform the same function.

The mechanism for raising lift tray 48 about the axis between pivot recesses 56 as lid 34 is opened will now be described. The elements of the mechanism include a rod bore 60 within end block 50 of lift tray 48, a lift rod 62 having an eye 64, a lift hinge pin 66, and a lift arm 68. Rod bore 60 is spaced somewhat to the right of pivot recesses 56 and preferably extends entirely through end block 50 in a direction perpendicular to the major axis of lift tray 48. The diameter of rod bore 60 is slightly greater than that of lift rod 62. The forward end of lift rod 62 lies along a linear axis within rod bore 60. The rearward end of lift rod 62 is bent into a circular shape to form eye 64. The center opening of eye 64 is slightly greater than the diameter of lift hinge pin 66. Eye 64 is held by lift hinge pin 66 between the projections of lift arm 68. Lift arm 68 forms generally a "C" shape with the back of the "C" connected to back 40 of lid 34. The forward ends of lift arm 68 project from back 40 and hold hinge pin 66 between them. Preferably, lift arm 68 is secured to back 40 just to the left of left hinge 46.

The preferred embodiment of case 20 includes a drawer 72 for the containment of miscellaneous articles typically related to the objects contained on lift tray 48. For example, if darts D are held on lift tray 48, items such as dart tips may be held within drawer 72. A drawer compartment 92 is formed within housing 22 between front 24, back 26, and bottom 28 within the left portion of housing 22. A separation wall 70 is preferably secured above bottom 28 of housing 22 between front 24 and back 26 and left end 30. Separation wall 70 acts as a top wall above drawer 72. Separation wall 70 is within a plane parallel to the surface of bottom 28 about midway up front 24 and back 26.

Drawer 72 is a typical drawer including a drawer faceplate 74, a rearward side 76, a forward side 78, an end wall 80, and a bottom wail 82. Drawer 72 thus forms an open box shape for containing articles. Faceplate 74 extends beyond rearward side 76 and forward side 78 such that drawer 72 cannot be slid too far within drawer compartment 92. The length of drawer 72 is preferably slightly less than half the length of housing 22. In the preferred embodiment of the invention for holding darts D, this allows room within housing 22 for fletchings of darts D to be held within the right side of housing 22 while the shafts and tips are held primarily above drawer 72.

Case 20 is provided with a lock mechanism to hold drawer 72 in place when lid 34 is closed. The lock mechanism includes a lock projection 84, a lock hole 86, and a lock notch 88. Lock projection 84 extends downwardly from the right rearward edge of plate portion 54 of lift tray 48. Lock projection 84 preferably has a triangular wedge shape. A corresponding wedge cutout forms lock notch 88 with the near vertical face of lock notch 88 being on the right side of the notch, corresponding to the near vertical face of lock projection 84 on the right side of lock projection 84. Lock hole 86 is provided within separation wall 70 to allow lock projection 84 to extend into lock notch 88. Lock hole 86 is generally rectangular in shape and is aligned between lock projection 84 and lock notch 88.

Figure 4:
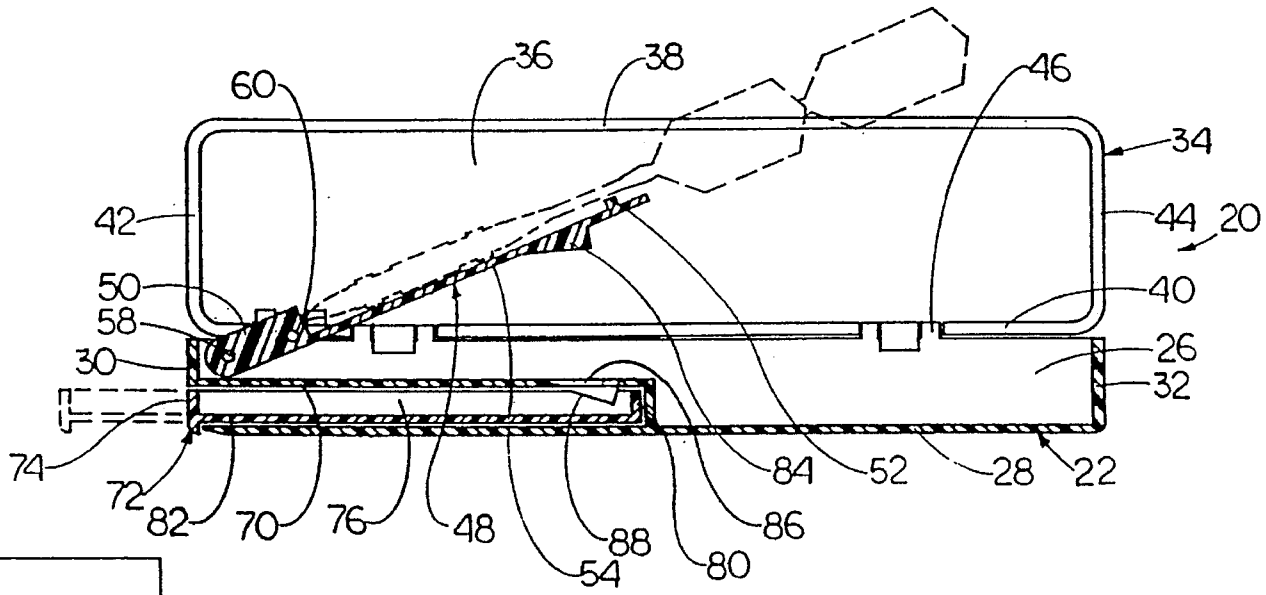
FIG. 4 is a cross-sectional elevational view of the container of the present invention in an open configuration.
Figure 5:
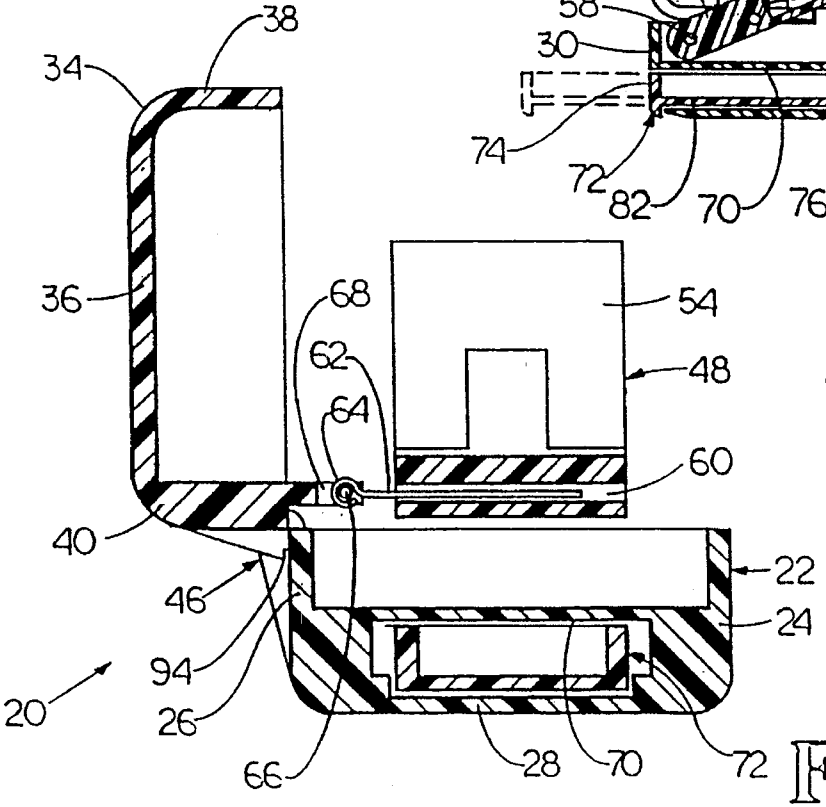
FIG. 5 is a cross-sectional end view of the container of the present invention shown in an open position.

Referring now to FIGS. 4–7, the basic operation of the lift mechanism of case 20 will now be described. FIG. 4 illustrates case 20 in an open position. In this position, lift tray 48 is lifted such that it has an upward slant of approximately 25 degrees from horizontal. Lift tray 48 is held to the right side of housing 22 about its pivotal connection with pivot recesses 56 holding pivot dimples 58. The upward position of the right side of lift tray 48 is maintained by lift arm 68 and hinge pin 66 holding lift rod 62. Lift rod 62 is slidably engaged within rod bore 60 such that, as lid 34 is lifted, hinge pin 66 of lift arm 68 rises. Rod 62 is held horizontally, since it is slidably engaged within rod bore 60, and thus the entire rod rises horizontally and lifts tray 48 from housing 22 about the pivotal connection to housing 22. A sliding interface between lift rod 62 and lift tray 48 is desirable, since hinge pin 66 also moves slightly toward front 24 as it swings upwardly with lid 34. Thus, lift rod 62 is allowed to slide inwardly within bore 60.

Note in FIG. 4 that lock projection 84 also rises with lift tray 48 such that drawer 72 is free to open when lid 34 is opened.

Figure 6:
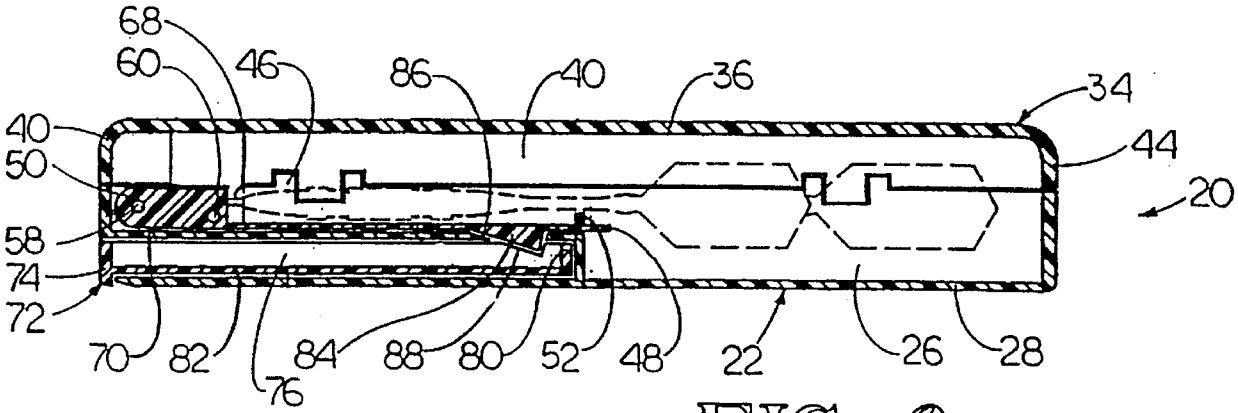
FIG. 6 is a cross-sectional elevational view of the container of the present invention illustrated in a closed configuration.
Figure 7:
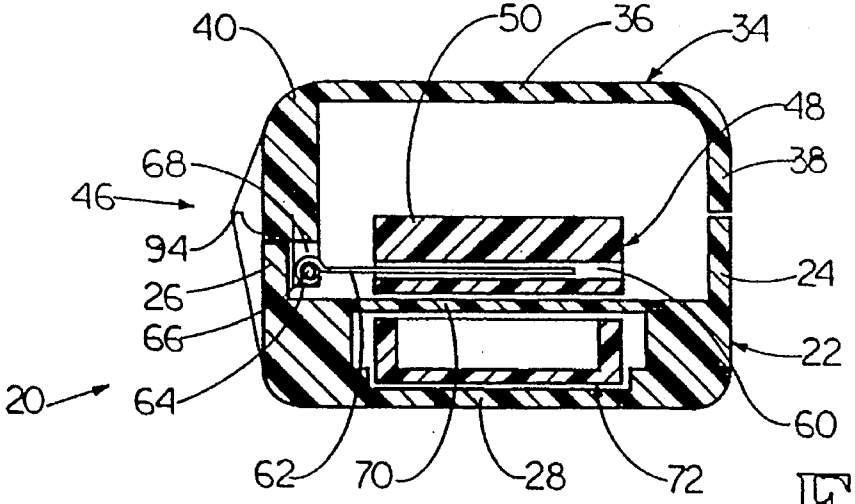
FIG. 7 is a cross-sectional end view of the container of the present invention shown in the closed position.

FIGS. 6 and 7 illustrate the closed position of case 20. As case 20 is closed lift arm 68 moves lift rod 62 and thus pivots lift tray 48 downwardly into housing 22. In this position, tray 48 is substantially parallel to bottom 28 of housing 22 against separation wall 70. Lock projection 84 projects within lock notch 88 through lock hole 86 such that drawer 72 cannot be opened. Note that any motion opening or closing lid 34 translates to a corresponding upward or downward movement of lift tray 48. Thus, the contents of lift tray 48 are automatically retracted within housing 22 as lid 34 is closed to avoid interference of lid 34 with the contents of lift tray 48.

In the open position, instruments or other objects, such as darts D, may easily be grasped and removed from lift tray 48. Therefore, with one simple action of opening lid 34 the contents of case 20 are easily accessible.

Figure 8:
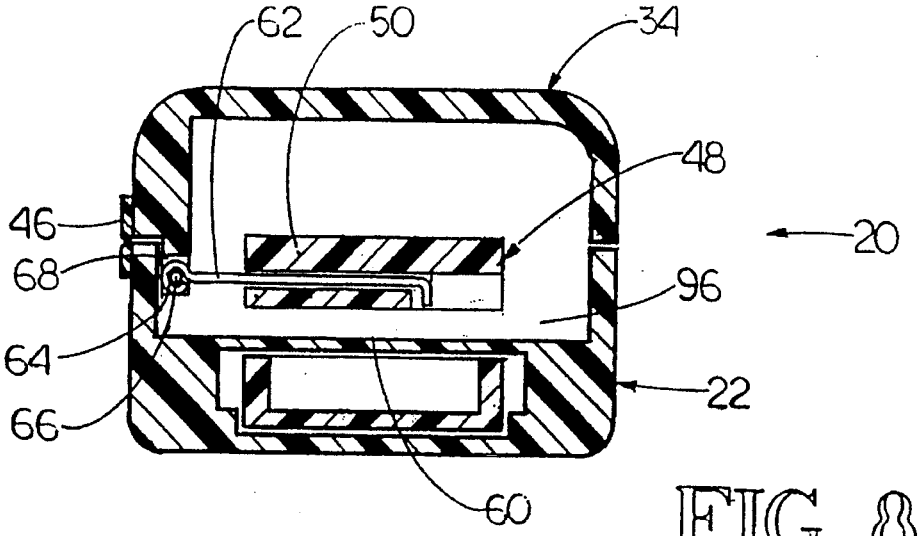
FIG. 8 is a cross-sectional end view of an alternate embodiment of the container of the present invention shown in a closed position.
Figure 9:
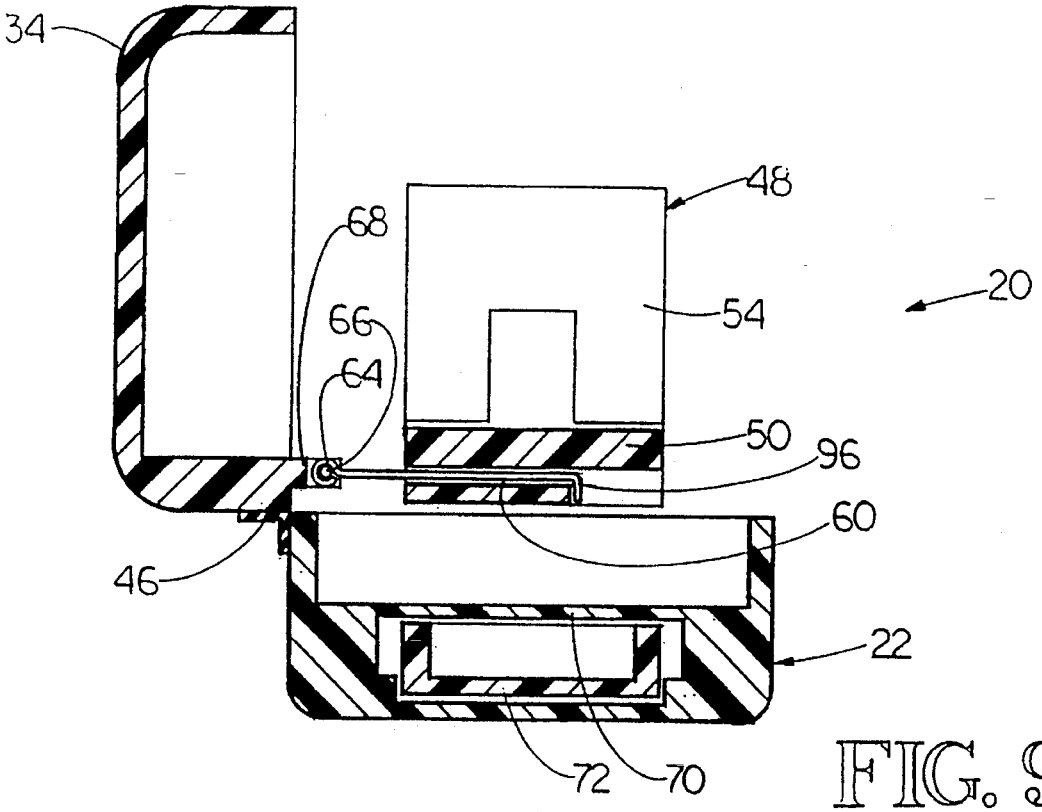
FIG. 9 is a cross-sectional end view of the container illustrated in FIG. 8 in an open position.

Referring now to FIGS. 8 and 9, an alternate embodiment of case 20 will now be described. The major difference in this embodiment is the provision of a bent portion 96 on the forwardmost end of lift rod 62. Also, rod bore 60 includes a wider cutaway portion at the forward end of the bore to accommodate bent portion 96. Bent portion 96 is simply a bend in the end of lift rod 62 in, preferably, a downward direction to form a stop. The stop for the lid occurs when bent portion 96 contacts the end of the cutaway portion of rod bore 60 so that lift arm 68 prevents lid 34 from pivoting rearwardly any further. In the embodiment illustrated in FIGS. 8 and 9, as lid 34 is opened, rod 62 slides forwardly until lid 34 is opened 90 degrees, after which the path of travel of lift hinge pin 66 is again rearward, such that rod 62 slides rearwardly until bent portion 96 contacts the end portion of rod bore 60. Note that live hinges are used in this embodiment rather than the previous hinges 46, which included an integral stop 94.

Figure 10:
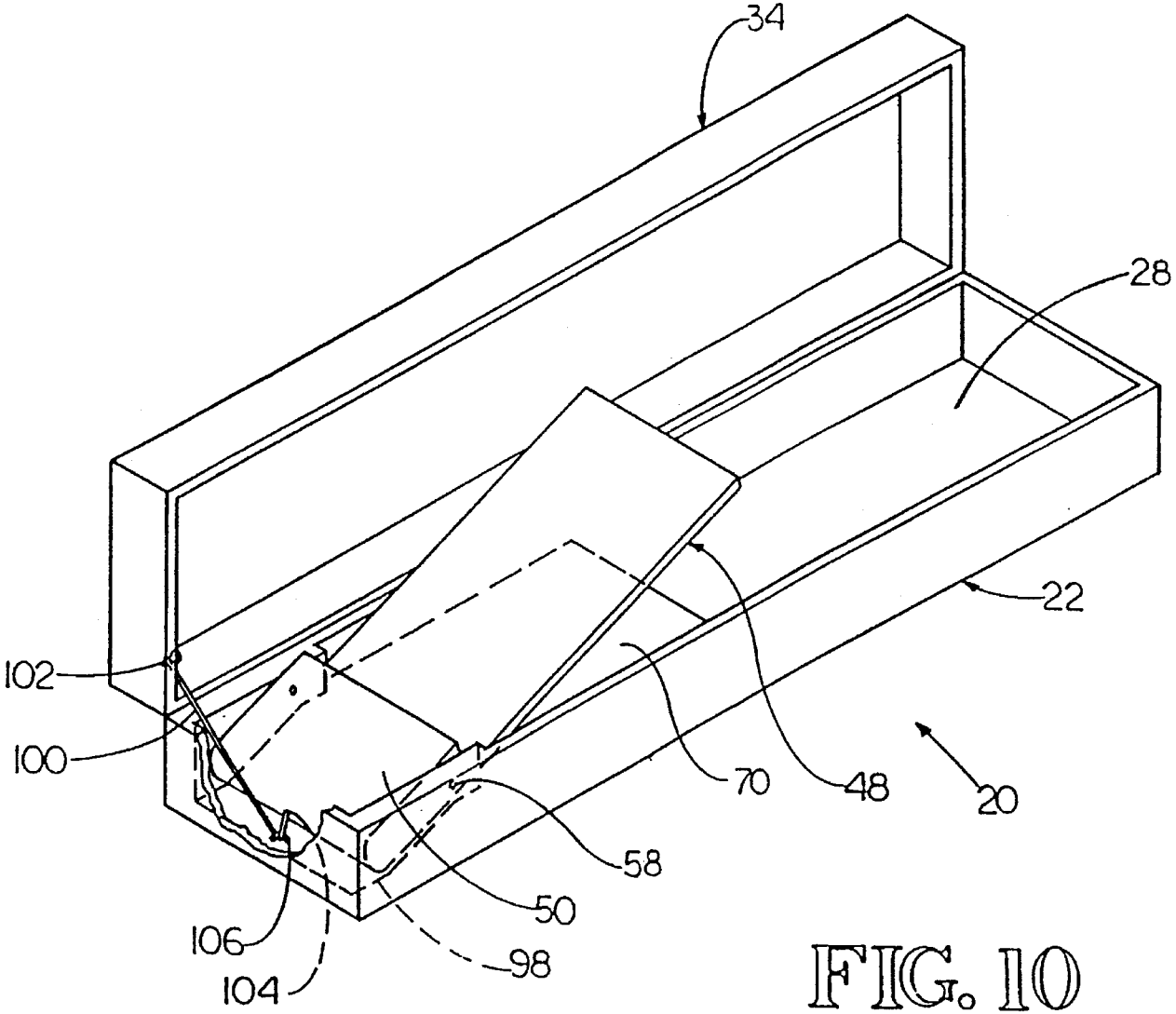
FIG. 10 is an isometric view of another alternate embodiment of the present invention.
Figure 11:
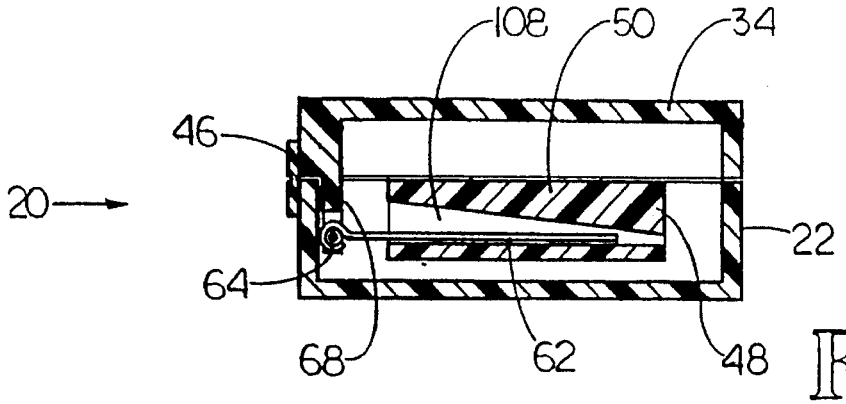

Referring now to FIG. 10, another alternate embodiment of the lift mechanism of case 20 is illustrated. This embodiment does not include a drawer but, instead, has a floor recess 98 within the left side of separation wall 70 to allow downward pivotal movement of the left end of end block 50. Alternatively, separation wall 70 may not be included at all. However, separation wall 70 is preferably included to provide a stop for lift tray 48 such that it rests in a plane parallel to the plane of bottom 28. In this embodiment, pivot recesses 66 and pivot dimples 58 are shifted to the right to be located along the same axis as rod bore 60 in the previous embodiments. A lift line 100 is provided between the leftwardmost end of end block 50 and lid 34. Lift line 100 is connected to lid 34 with a lid attachment mount 102 securing it to left end 42 of lid 34. Line 100 then extends downwardly into housing 22 and through a line slide mount 106 secured to bottom 28 of housing 22. Line 100 then bends through slide mount 106 and is securely attached to end block 50 with a block attachment mount 104.

When lid 34 is opened, line 100 is pulled upwardly with left end 42 of lid 34 such that the left end of end block 50 is pulled downwardly into floor recess 98. Since lift tray 48 is pivotally secured to the right of block attachment mount 104, plate portion 54 of lift tray 48 rises upwardly to lift whatever contents are on lift tray 48.

Figure 11:
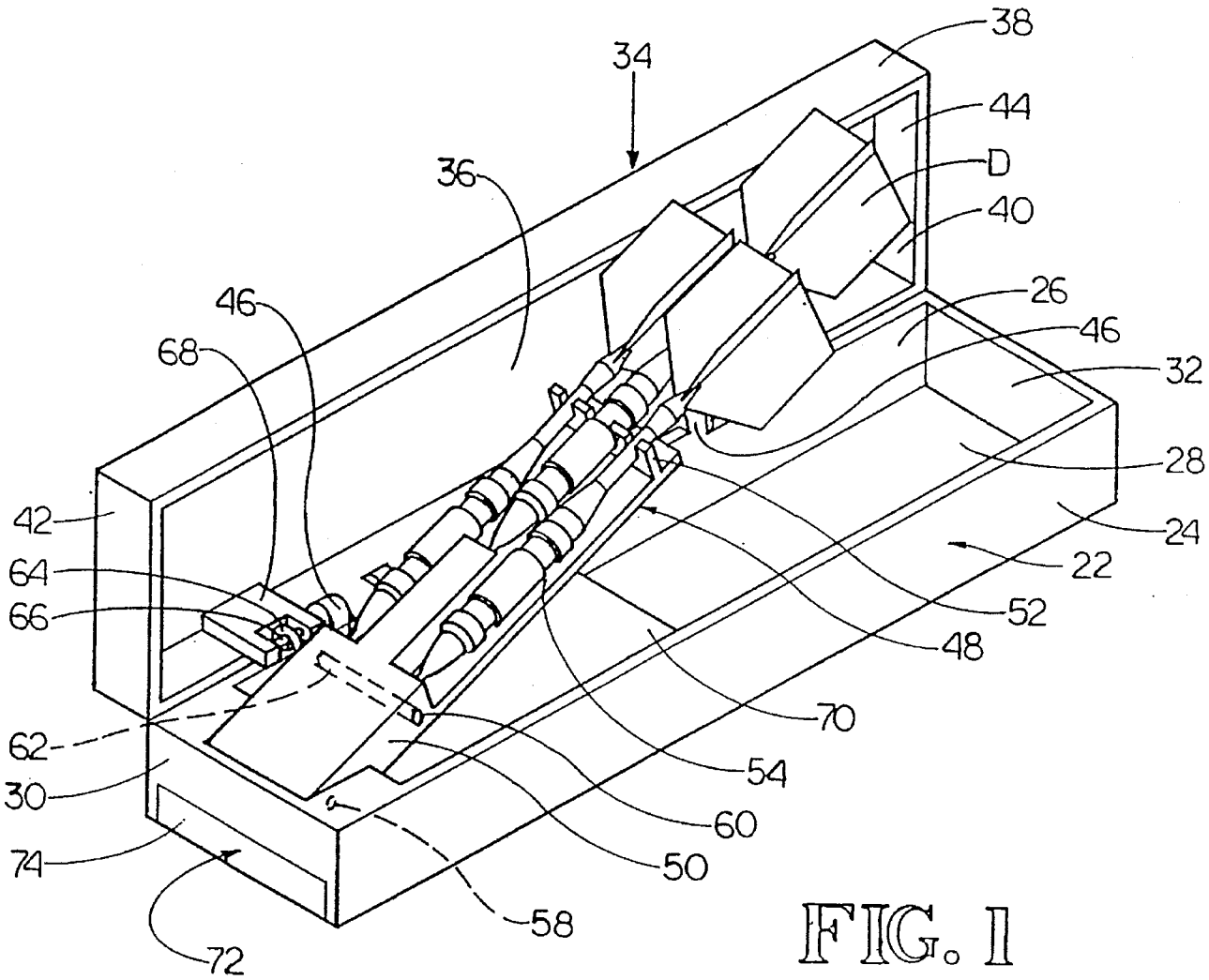
FIG. 11 is a cross-sectional end view of another alternate embodiment of the present invention shown with the lid in a closed position.
Figure 12:
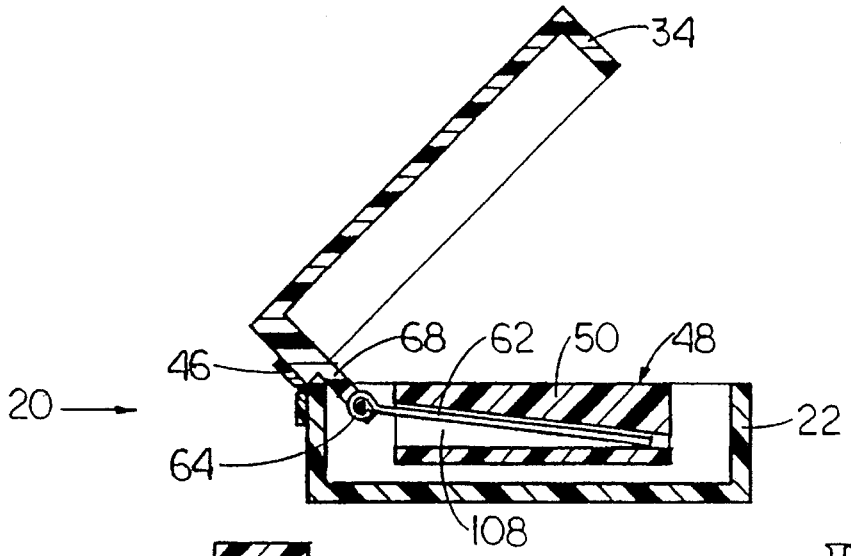
FIG. 12 is a cross-sectional end view of the embodiment illustrated in FIG. 11 shown in a partially open position.
Figure 13:
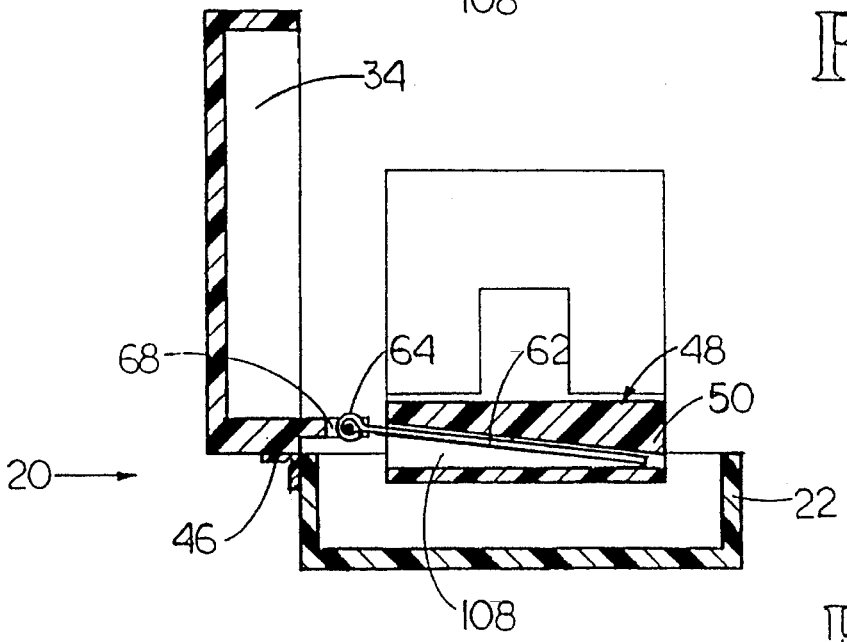
FIG. 13 is a cross-sectional end view of the embodiment illustrated in FIG. 11 shown in a fully open position.
Figure 14:
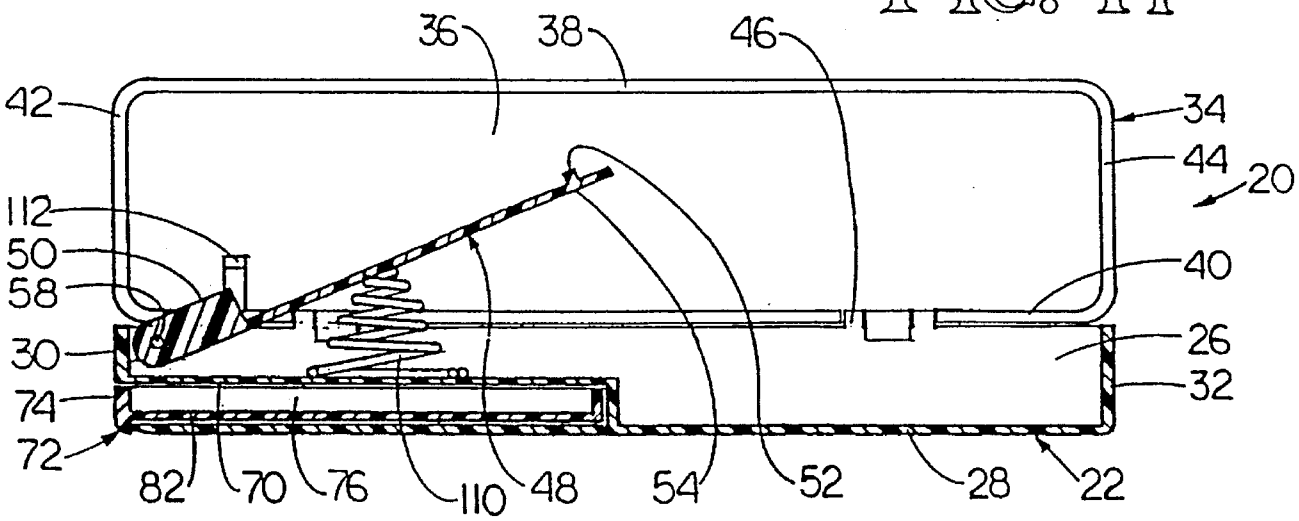
FIG. 14 is a cross-sectional elevational view of another embodiment of the present invention that uses a spring shown in the open position.
Figure 15:
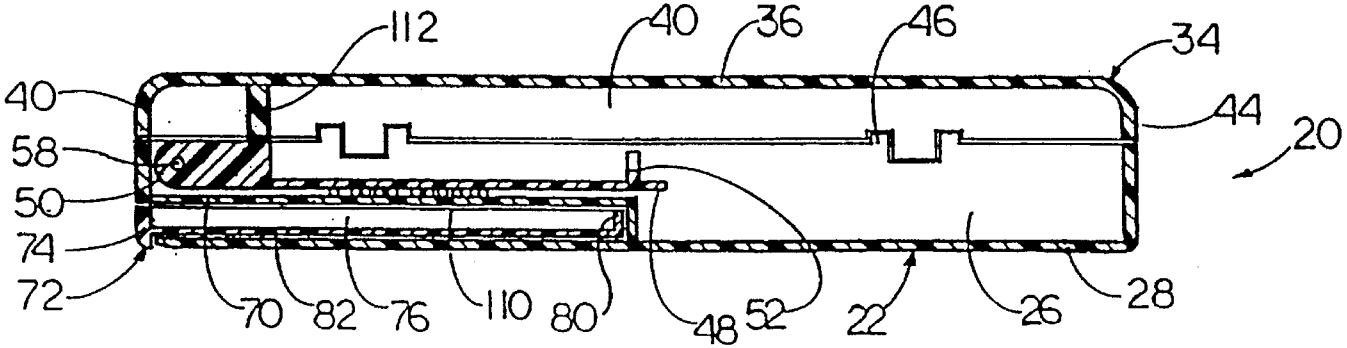
FIG. 15 is a cross-sectional elevational view of the embodiment illustrated in FIG. 14 shown in a closed position.
Figure 16:
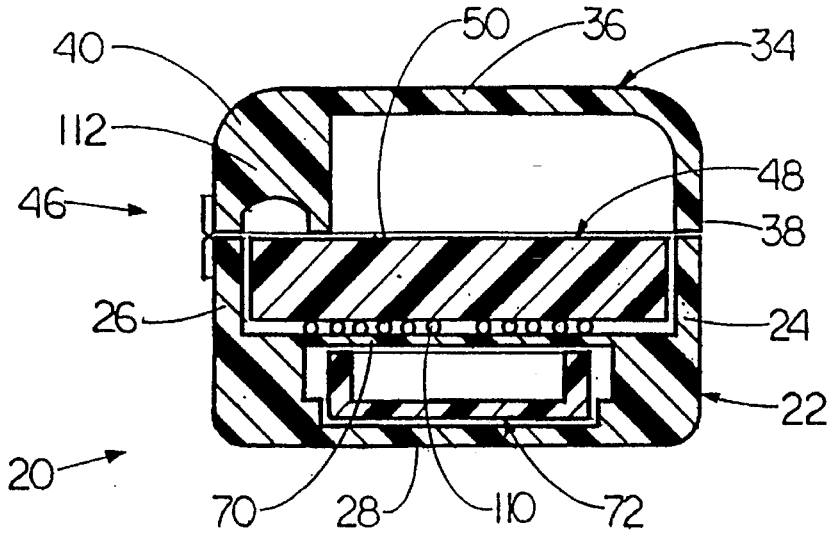
FIG. 16 is a cross-sectional end view of the embodiment illustrated in FIG. 14 shown in a closed position.
Figure 17:
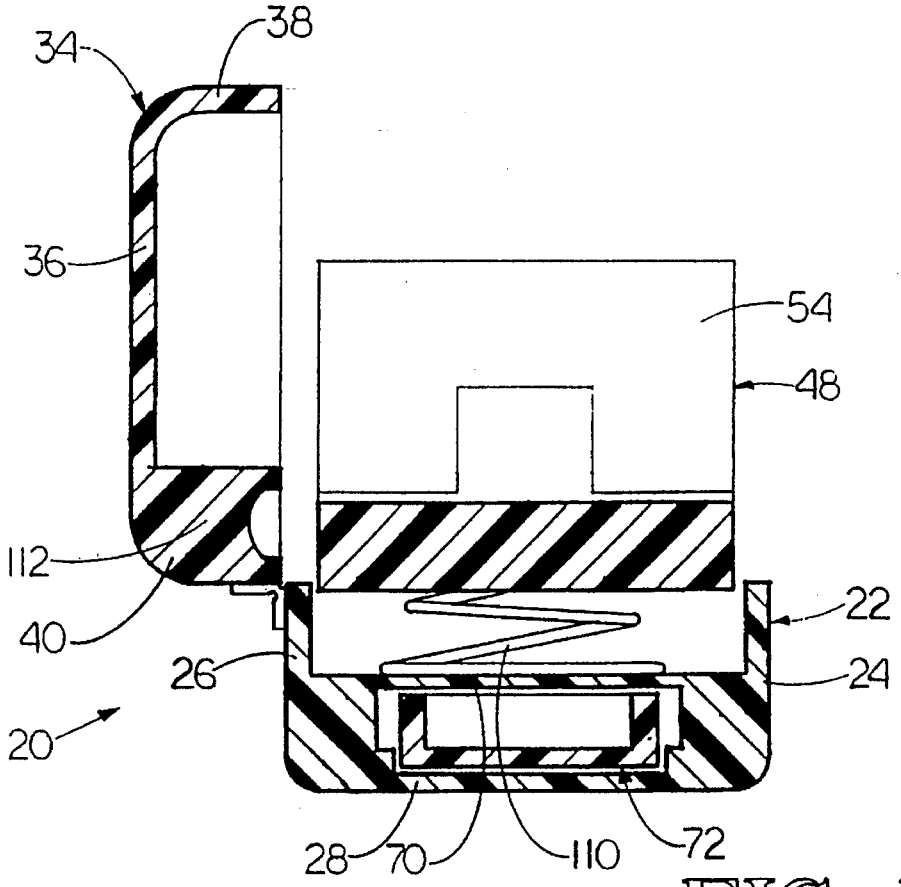
FIG. 17 is a cross-sectional end view of the embodiment illustrated in FIG. 14 shown in an open position.

Referring now to FIGS. 11–13, another alternate embodiment of the invention will be described that provides for delayed lifting of lift tray 48 from housing 22. This embodiment is similar to the preferred embodiment described in connection with FIGS. 1–7. However, in this embodiment a flared rod recess 108 is used instead of rod bore 60. Flared rod recess 108 is generally wedge shaped with the tallest portion of the wedge recess being at the rearward side of end block 50. Thus, as lid 34 is initially lifted, as illustrated in FIG. 12, no lifting of tray 48 occurs, since lift rod 62 simply swings within flared recess 108. However, as lid 34 is further opened, lift rod 62 comes into contact with the upper surface of flared rod recess 108 and then proceeds to raise lift tray 48 from housing 22.

This arrangement may be desirable where the contents of lift tray 48 are quite large and may tend to interfere with lid 34 if they were instantly lifted upon any upward movement of lid 34. Such a situation may occur where, for example, darts D project well beyond the rightwardmost edge of lift tray 48. In such a case, a delayed action would ensure that the rightwardmost ends of darts D would be kept low enough to avoid interference with closing or opening of lid 34.

FIGS. 14–17 illustrate another embodiment of case 20 of the present invention. In this embodiment a lift spring 110 is used to bias lift tray 48 in an upward direction about its pivotal connection to housing 22. Spring 110 is preferably a conical helical compression spring having its base secured to separation wall 70 with its apex secured to the underside of plate portion 54 of lift tray 48. A retraction arm 112 is preferably provided within lid 34 in the location that lift arm 68 occupies in the embodiment shown in FIG. 1. Retraction arm 112 is simply a projection extending perpendicular to top 36 of lid 34 to contact end block 50 and push it downwardly against the biasing force of spring 110. Thus, as lid 34 is opened, retraction arm 112 allows lift tray 48 to pivot upwardly. As lid 34 is closed, retraction arm 112 pushes downwardly on end block 50 to retract lift tray 48 within housing 22. A small separation is provided between plate portion 54 of lift tray 48 and separation wall 70 to allow for the compressed state of spring 110.

Figure 18:
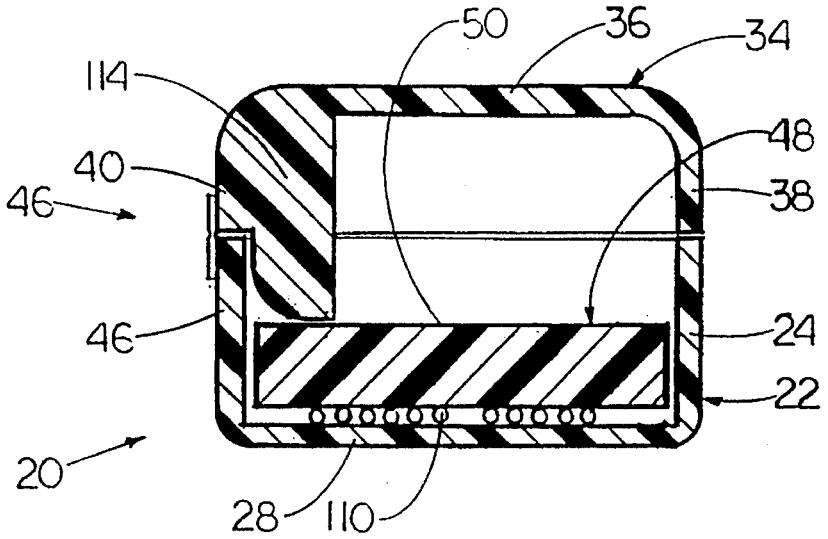
FIG. 18 is a cross-sectional end view of another embodiment of the invention similar to the embodiment illustrated in FIG. 14 but having a retraction cam instead of a retraction arm shown in a closed position.
Figure 19:
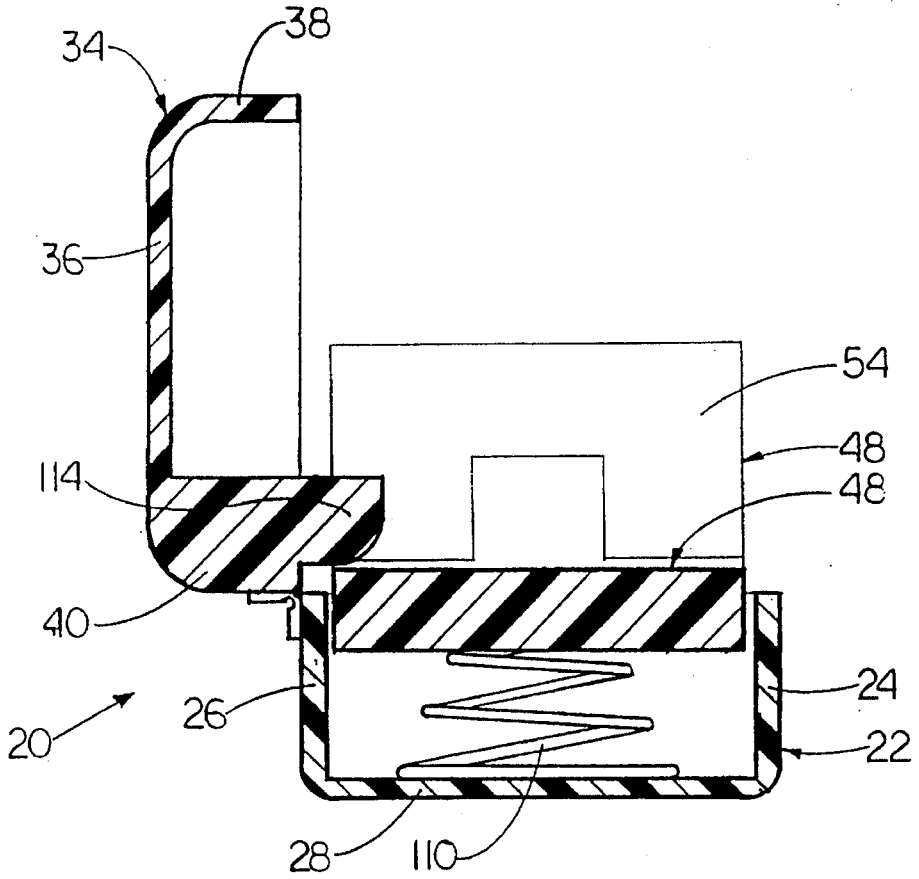
FIG. 19 is a cross-sectional end view of the embodiment illustrated in FIG. 18 shown in an open position.

FIGS. 18 and 19 illustrate an alternate embodiment of arm 112. In this embodiment a retraction cam 114 is used to contact end block 50 of lift tray 48. The specific surface shape of retraction cam 114 can be varied for differing speeds of retraction or extension as lid 34 is closed or opened, respectively.

The preferred embodiments of case 20 have been described in relation to holding objects such as darts D. However, other possible uses include cases for pens/pencils, medical/dental instruments, syringes, thermometers, knives and/or cutlery, pool cues, drill bits, jeweler's screwdrivers or other tools, or playing cards, a storage container for computer disks, and most any other use where an object is to be lifted from a container at the opening of the lid for easy access to the object. It may be used in automobile compartments for objects such as sunglasses or other items.

While the preferred embodiments of the invention have been illustrated and described, it will be appreciated that various changes can be made therein without departing from the spirit and scope of the invention.

The embodiments of the invention in which art exclusive property or privilege is claimed are defined as follows:

1. A container for storing objects comprising:

(a) a housing;

(b) a lid pivotally attached to said housing;

(c) a tray pivotally attached within said housing, said tray having means for removably securing objects thereon; and (d) a lift mechanism coupled between said tray and said lid for lifting at least a portion of said tray upon opening of said lid, said lift mechanism including:

(i) a lift arm secured to said lid; and (ii) a lift member pivotally coupled to said lift arm and slidably coupled to said tray.

2. The container of claim 1, wherein said lid and said tray pivot about different axes, the pivot axis of said tray being generally transverse to the pivot axis of said lid.

3. The container of claim 1, further comprising a drawer slidably coupled within said housing beneath said tray.

4. The container of claim 3, wherein said housing includes a wall disposed between said drawer and said tray.

5. A container for storing objects comprising:

(a) a housing;

(b) a lid pivotally attached to said housing;

(c) a tray pivotally attached within said housing, said tray having means for removably securing objects thereon;

(d) a lift mechanism coupled between said tray and said lid for lifting at least a portion of said tray upon opening of said lid, said lift mechanism including:

(i) a lift arm secured to said lid; and (ii) a lift member pivotally coupled to said lift arm and slidably coupled to said tray; and (e) a drawer slidably coupled within said housing beneath said tray, wherein said tray includes a lock projection that extends below the bottom surface of said tray and projects within at least a portion of said drawer when said lid is in a closed position on said housing.

6. The container of claim 5, wherein said lock projection is a wedge and wherein said drawer includes a complementary recess for receiving said wedge.

7. A container for storing objects comprising:

(a) a housing;

(b) a lid pivotally attached to said housing;

(c) a tray pivotally attached within said housing, said tray having means for removably securing objects thereon, wherein said lid and said tray pivot about different axes, the pivot axis of said tray being generally transverse to the pivot axis of said lid; and (d) a lift mechanism coupled between said tray and said lid for lifting at least a portion of said tray upon opening of said lid, said lift mechanism including:

(i) a lift arm secured to said lid; and (ii) a lift member pivotally coupled to said lift arm and slidably coupled to said tray, wherein said lift member is slidably coupled to said tray.

8. The container of claim 7, wherein said lift arm projects downwardly from said lid past the pivotal connection of said lid to said housing.

9. The container of claim 8, wherein said lift member comprises a rod and said tray includes a tapered rod recess for receiving said rod, said recess having its wide portion near said lift arm to provide delayed lifting of said tray upon opening of said lid.

10. The container of claim 8, wherein said lift member includes an end with a hook and said tray includes a recess for receiving said lift member and said hook, a portion of said recess near the end of said lift member being wider for receiving said hook and for contacting said hook to stop pivotal movement of said lid.

11. The container of claim 8, wherein said lid further includes a stop member for limiting pivotal movement of said lid.

12. The container of claim 8, wherein said housing includes a support member beneath said tray for holding said tray in a predetermined orientation within said housing when said lid is closed on said housing.

13. A container for storing objects comprising:

(a) a housing;

(b) a lid pivotally attached to said housing;

(c) a tray pivotally attached within said housing, said tray having means for removably securing objects thereon, wherein said lid and said tray pivot about different axes, the pivot axis of said tray being generally transverse to the pivot axis of said lid; and (d) a lift mechanism coupled between said tray and said lid for lifting at least a portion of said tray upon opening of said lid, said lift mechanism including:

(i) a lift arm secured to said lid; and (ii) a lift member pivotally coupled to said lift arm and slidably coupled to said tray.

* * * * *